US007185492B2

(12) United States Patent
Dieter

(10) Patent No.: US 7,185,492 B2
(45) Date of Patent: Mar. 6, 2007

(54) STIRLING ENGINE HAVING SLIDABLE PISTON

(76) Inventor: Robert L. Dieter, 919 Cliffwood Dr., Mt. Pleasant, SC (US) 29464

( * ) Notice: Subject to any disclaimer, the term of this patent is extended or adjusted under 35 U.S.C. 154(b) by 0 days.

(21) Appl. No.: 11/195,899

(22) Filed: Aug. 3, 2005

(65) Prior Publication Data

US 2006/0156721 A1 Jul. 20, 2006

Related U.S. Application Data

(60) Provisional application No. 60/644,472, filed on Jan. 14, 2005.

(51) Int. Cl.
*F01B 29/10* (2006.01)

(52) U.S. Cl. ..... 60/519; 60/517

(58) Field of Classification Search ..... 60/517, 60/519

See application file for complete search history.

(56) References Cited

U.S. PATENT DOCUMENTS

| | | | | | |
|---|---|---|---|---|---|
| 2,974,603 | A * | 3/1961 | Fraser | ..... | 418/111 |
| 3,537,256 | A * | 11/1970 | Kelly | ..... | 60/519 |
| 4,009,573 | A * | 3/1977 | Satz | ..... | 60/519 |
| 4,044,559 | A * | 8/1977 | Kelly | ..... | 60/525 |
| 4,138,847 | A * | 2/1979 | Hill | ..... | 60/508 |
| 5,233,966 | A * | 8/1993 | Berg | ..... | 123/27 R |
| 5,239,833 | A * | 8/1993 | Fineblum | ..... | 62/6 |
| 5,325,671 | A * | 7/1994 | Boehling | ..... | 60/682 |
| 5,442,923 | A * | 8/1995 | Bareiss | ..... | 62/6 |
| 6,575,719 | B2 * | 6/2003 | Manner et al. | ..... | 418/61.2 |

* cited by examiner

*Primary Examiner*—Hoang Nguyen
(74) *Attorney, Agent, or Firm*—B. Craig Killough

(57) ABSTRACT

The present invention is a rotary engine having a rotor and a slidable piston that are contained within a stator.

16 Claims, 4 Drawing Sheets

STIRLING ENGINE HAVING SLIDABLE PISTON

Applicant claims the benefit of Provisional Application Ser. No. 60/644,472 filed Jan. 14, 2005

FIELD OF THE INVENTION

This invention relates to engines.

BACKGROUND OF THE INVENTION

Most existing Stirling cycle engines rely on reciprocating pistons, connecting rods and crankshaft systems. Others require heat regenerators, and have complex components that are often expensive to produce. Heat loss in these engines is frequently high, and therefore, the engine is inefficient.

SUMMARY OF THE INVENTION

The present invention is a rotary Stirling cycle engine. The engine is compact, lightweight and easy to manufacture. The engine has a rotor and a slidable piston that are contained within a stator. The resulting engine is compact, light weight and high in volumetric efficiency. Since the motion is rotary, the engine operates with little noise or vibration. The engine is capable of using a wide variety of fuels including conventional, low volatility, geothermal, solar and waste heat.

DESCRIPTION OF THE PREFERRED EMBODIMENT

Figure 1A:
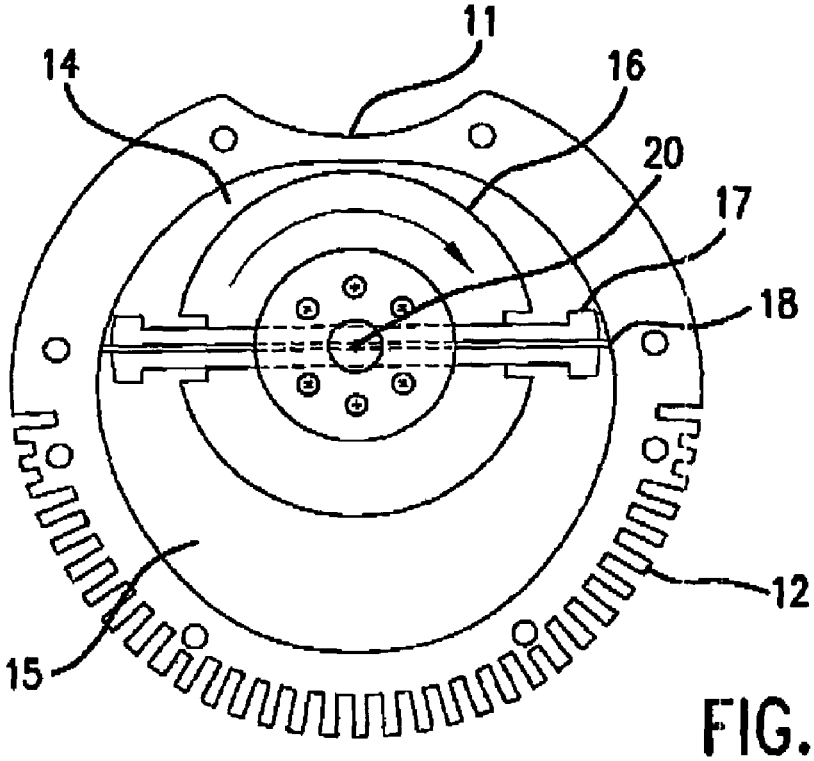
FIG. 1A is a sectioned view through an axis of the engine.
Figure 1B:
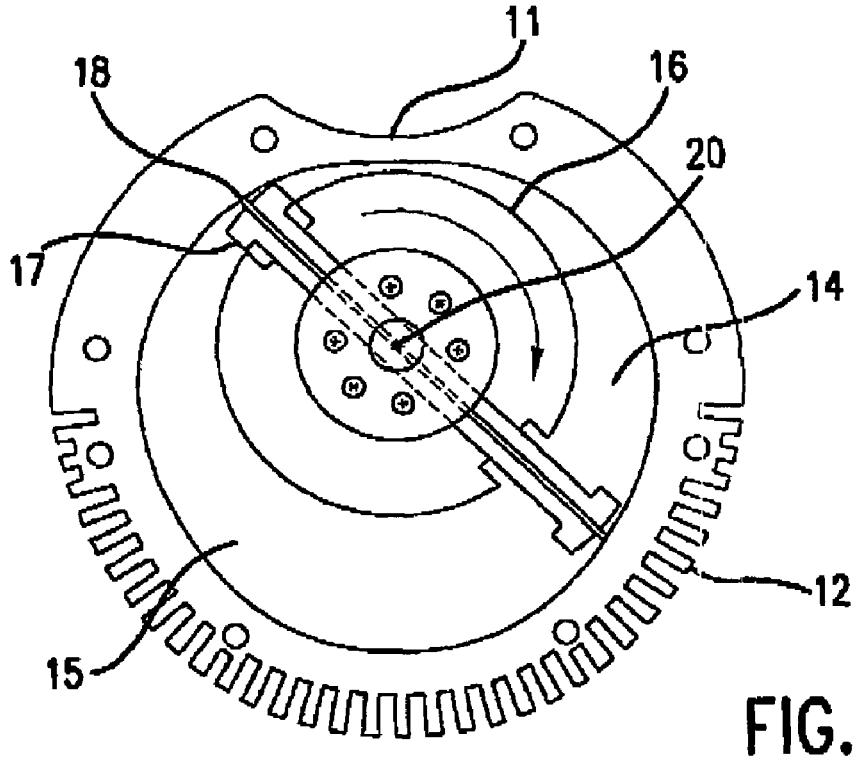
FIG. 1B is a sectioned view through the same axis of the engine, with the rotor 16 having rotated clockwise from the position shown in FIG. 1A.
Figure 1C:
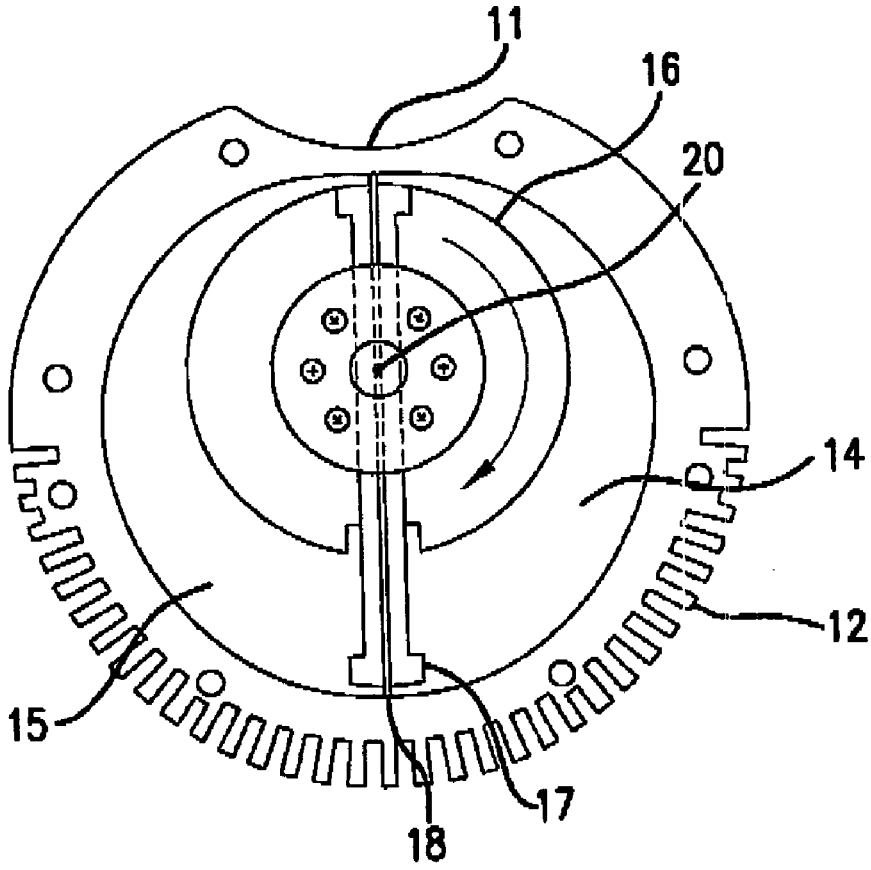
FIG. 1C is a sectioned view through the same axis of the engine, with the rotor 16 having rotated 180° C. from the position shown in FIG. 1A.

In the preferred embodiment, the engine has a stator 10, a rotor 16 and a slidable piston 17 that slides within the rotor. FIG. 1A and FIG. 1B. The stator 10 is preferred to have an irregular, and annular, generally cylindrical chamber in which the rotor rotates. The diameter of the annular chamber, when taken from any direction though the axis of rotation of the rotor, is constant, subject to reasonable manufacturing tolerances. The annular chamber is not circular where the rotor rotates within the chamber, as demonstrated by the sectional views of FIG. 1A and FIG. 1B.

The rotor 16 is mounted axially, and the center of rotation is offset from the center of the chamber, so that the axis of rotation of the rotor is not in the center of the chamber. The rotor may be circular when viewed as in FIG. 1A, or have an overall generally cylindrical shape, FIG. 2.

Slidable piston 17 is positioned within the rotor. The slidable piston is fitted with seals 18 and is slidably mounted within the rotor through axis of the rotor. Each end of piston 17 remains in contact with the wall of the chamber as the rotor rotates about its axis. Since the length of the piston is fixed, this contact by both ends of the piston with the chamber walls at all times is achieved by the irregularly shaped chamber having a diameter that is constant when the diameter is measured from any direction and though the axis of rotation of the rotor. As the rotor rotates, the piston slides within the rotor, and the piston projects from one side of the rotor while retracting on the opposite side of the rotor, depending upon the position of the rotor within the chamber. Retraction and projection of the ends alternates in the preferred embodiment, with one side fully retracting as the opposite side fully projects, and the opposite then fully retracting as the one side fully projects, with each end of the piston fully projecting and fully retracting during one rotational cycle.

The piston, and specifically, the seals thereof, remain in contact with the opposing walls of the stator 10 when viewed as in FIGS. 1A and 1B. The piston also has seals along its length that contact the interior of the end cover plates 13 of the stator as the rotor rotates. The seals are heat tolerant and help to form the subchambers as described herein. For the purpose of the claims, the seals are included as part of the piston.

The stator as shown in the preferred embodiment has end cover plates 13, that cover the generally cylindrical chamber at each end. The cover plates define, along with the piston, a first subchamber 14 and a second subchamber 15. The subchambers are of variable volume, as determined by the position of the rotor 16 as it rotates. In the position shown in FIG. 1A, the first chamber is a relatively hotter compression chamber, while the second chamber is a relatively cooler expansion chamber.

Figure 2:
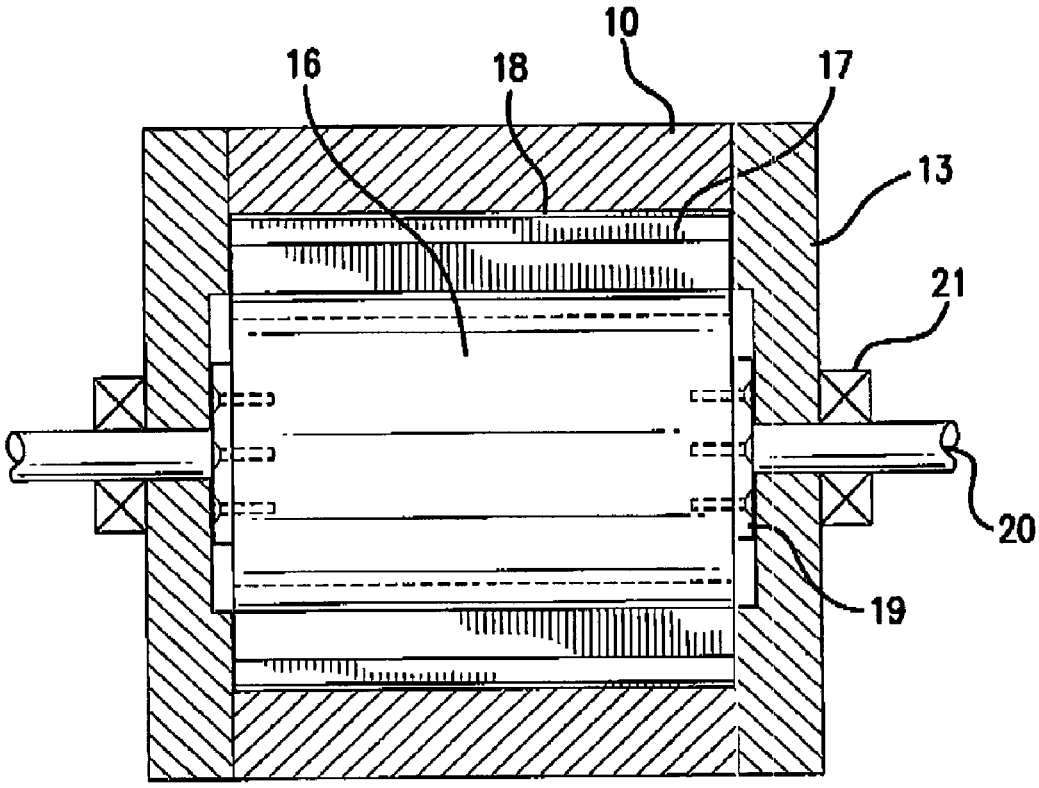
FIG. 2 is a cross section along the axis.
Figure 3:
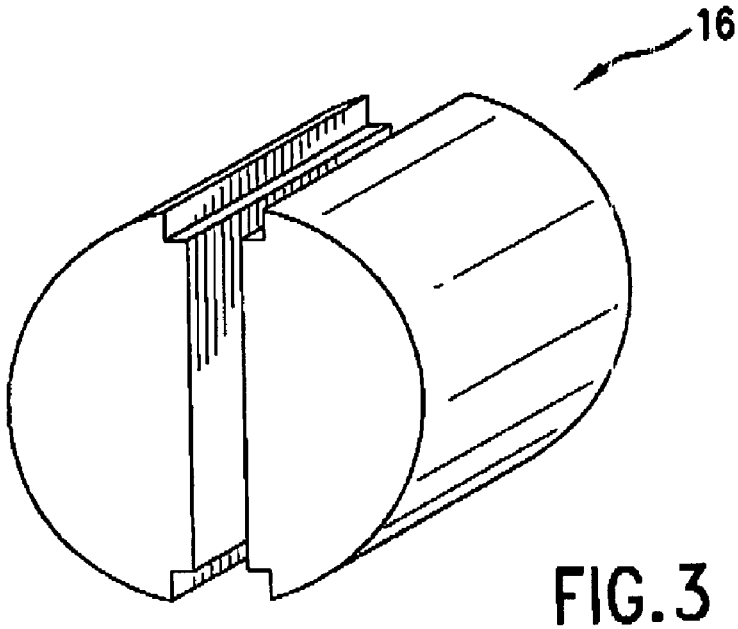
FIG. 3 is a perspective view of the rotor 16
Figure 4:
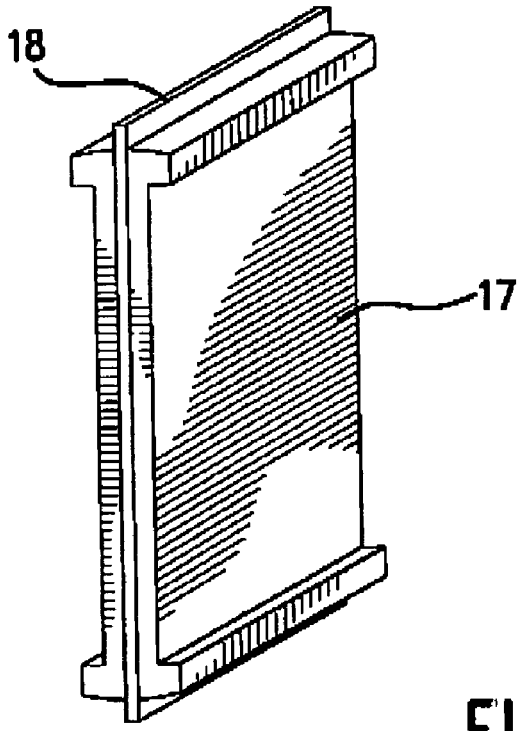
FIG. 4 is a perspective view of the slidable piston 17.

End cover plates 13 seal the ends of the stator 10, but permit the power shaft 20 of the rotor hub 19 to pass there through. FIG. 2. The power shaft 20 is suitably fitted with bearings 21 and seals 18 to enable the stator to maintain a substantially hermetically sealed environment for the chamber. A flywheel and starter may be attached to the power shaft 20 to assist in starting and to reduce vibration.

The power shaft may form the axis around which the rotor rotates. While the rotor rotates within the chamber, it does not otherwise shift or move around within the chamber, so that the rotational axis remains in the same position in the chamber.

In use, a heat source transfers heat to the exterior of the rotor stator heating area 11, such as by conduction, convection or radiation. The heat so supplied is then transferred through the stator wall, where the confined and compressed gas is heated. "Gas" may include, but is not limited to, atmospheric air, hydrogen, helium or any special combination of gasses selected for optimum heat transfer and performance. The gas may be inserted into the chamber under pressure, if desired. The heat acts upon the confined gas to further increase the pressure of the gas. The gas under pressure exerts a force on the slidable piston 17, causing rotation of the piston and rotor 16, and the power shaft 20. In a preferred embodiment, the piston is in a slightly offset relationship relative to the rotor, with more area of the piston on the side exposed to the pressure initially, to aid in starting, and to determine the direction of rotation.

As the rotor 16 continues to rotate, the expanding gasses that are present in the subchamber are moved by the piston into the larger and cooler subchamber area of the stator. Work is extracted from engine as the engine operates, which removes heat. Heat is removed from the gas that is present in the lower subchamber, such as by the use of cooling fins 12, or other heat exchanger. The pressure of the gas is also lowered as the subchamber is enlarged by rotation of rotor. The seals substantially prevent a transfer of gas from one subchamber to the other.

The resulting expansion area and compression area of the stator operate simultaneously, but 180 degrees out of phase. Slidable piston 17 shifts through the axis of the rotor 16 to maintain contact with an opposing wall of the stator 10 and cover plates 13. Except for a brief transition position, such as shown in FIG. 1B, when one subchamber is compressing and heating the gas within that subchamber, the other chamber 15 is cooling and decompressing the gas within it, as shown in FIG. 1A.

In one embodiment, the rotor is carried on an eccentric shaft. Other stator configurations allow alteration of compression ratios. Pistons of other than those having fixed radial dimensions, including varying shapes or sliding vanes, for example, may also be utilized. The piston can be restrained in its radial travel by a simple gear, springs or other means, if desirable to minimize wear on the stator wall. Any suitable balancing method may be employed, if required, for high velocity operation. The primary requirement is that the overall effective length of the piston remain constant, so that the piston or pistons form subchambers by contact with opposing walls of the chamber. For example, if two opposing spring loaded pistons are used, the end of each will contact the chamber wall on opposite sides, with the overall effective length of the pistons being the same at all times, since the diameter of the chamber through the axis of the rotor is constant when the axis is approached from any direction.

Cooling for the engine generally or the rotor specifically may be provided. Internal cooling to the rotor may be accomplished through passageways extending to and communicating with the exterior. Air or other gases, or liquid coolants, may be transported through the passageways to the rotor.

The engine according to the invention is environmentally friendly and can furnish power for many applications. The external combustion by-products are generally more easily regulated and controlled than those from internal combustion engines. The ability of the engine to use low volatility fuels makes it safer to operate. Since the engine is a sealed system, crankcase pollution is eliminated. The engine can operate as a single unit, "multi-cylinder" or in tandem, depending upon horsepower and space requirements.

What is claimed is:

1. A Stirling cycle engine, comprising:

a stator having a chamber;

a rotor that rotates within said chamber, a piston that is slidably mounted within said rotor, wherein a first end of said piston remains in contact with a wall of said chamber through an annular rotation of said piston, and an opposite end of said piston remains in contact with said wall of said chamber through said annular rotation of said piston;

wherein said chamber has a substantially constant width when a linear measurement is taken from any point on said wall of said chamber to an opposite point on said wall of said chamber through an axis of rotation of said rotor.

2. A Stirling cycle engine as described in claim 1, wherein said chamber is generally cylindrical.

3. A Stirling cycle engine as described in claim 1, wherein a cross section of said chamber is of irregular shape.

4. A Stirling cycle engine as described in claim 1, wherein said rotor rotates about an axis that is not in a center of said chamber.

5. A Stirling cycle engine as described in claim 1, wherein said piston slidably and linearly traverses said rotor as said rotor rotates within said chamber.

6. A Stirling cycle engine as described in claim 1, wherein said chamber has a gas therein, and when said engine is in operation, gas is neither received into said chamber and nor discharged from said chamber.

7. A Stirling cycle engine as described in claim 1, wherein said engine further comprises a heat source that is adjacent to one side of said stator, and wherein a first subchamber is present between a first side of said piston and a first portion of said stator wall and a second subchamber is present between an opposite and second side of said piston and an opposite and second portion of said stator wall, and wherein a volume of said first subchamber is smaller than a volume of said second subchamber when said first subchamber is closer to said heat source than is said second subchamber.

8. A Stirling cycle engine as described in claim 1, wherein one side of said stator has a heat source adjacent thereto that supplies heat to said chamber, and an opposite side of said stator comprises a heat exchanger that removes heat from said chamber.

9. A Stirling cycle engine as described in claim 1, wherein a distance of said first end of said piston from said rotor is variable as said rotor rotates within said chamber.

10. A Stirling cycle engine as described in claim 1, wherein said chamber is generally cylindrical, and wherein said rotor rotates about an axis that is not centered within said chamber.

11. A Stirling cycle engine as described in claim 1, wherein said first end of said piston projects from said rotor as said rotor rotates within said chamber while said opposite end of said piston simultaneously retracts toward said rotor as said rotor rotates within said chamber.

12. A Stirling cycle engine as described in claim 1, wherein said first end of said piston contacts a wall of said chamber and projects from said rotor as said rotor rotates within said chamber while said opposite end of said piston contacts an opposite wall of said chamber and simultaneously retracts toward said rotor as said rotor rotates within said chamber.

13. A Stirling cycle engine as described in claim 1, wherein said first end of said piston contacts a wall of said chamber and an opposite end of said piston contacts an opposite wall of said chamber.

14. A Stirling cycle engine as described in claim 1, wherein said piston is of a constant length and first end of said piston contacts a wall of said chamber and an opposite end of said piston contacts an opposite wall of said chamber.

15. A Stirling cycle engine as described in claim 1, wherein said piston slides in a channel that is formed through a center of said axis of rotation of said rotor.

16. A Stirling cycle engine as described in claim 1, wherein said piston slides in a channel that extends from a first side of said rotor to an opposite side of said rotor and through a center of said axis of rotation of said rotor.

* * * * *